United States Patent [19]

Huling

[11] 4,435,928

[45] Mar. 13, 1984

[54] LOW ENERGY BUILDING

[76] Inventor: Edwin Huling, Houghton Hill Rd., Thetford Hill, Vt. 05074

[21] Appl. No.: 249,149

[22] Filed: Mar. 30, 1981

[51] Int. Cl.[3] ..... E04B 7/02

[52] U.S. Cl. ..... 52/90; 52/309.4

[58] Field of Search ..... 52/90–94, 52/665, 666, 474, 292, 293, 299, 586, 509, 512, 483, 127.1, 309.4

[56] References Cited

U.S. PATENT DOCUMENTS

| | | | |
|---|---|---|---|
| 794,595 | 7/1905 | Ducker | 52/92 |
| 1,321,213 | 11/1919 | Johnson | 52/666 |
| 1,372,206 | 3/1921 | Stadelman | 52/293 |
| 1,421,124 | 6/1932 | Brandt | 52/92 |
| 1,723,621 | 8/1929 | Jewell | 52/512 |
| 2,107,240 | 2/1938 | Eilertsen | 52/474 |
| 2,128,405 | 8/1938 | Eastman | 52/207 |
| 2,253,667 | 8/1941 | Warner | 52/785 |
| 2,378,275 | 6/1945 | Williamson | 52/92 |
| 2,893,075 | 7/1959 | Potchen et al. | 52/745 |
| 3,230,681 | 1/1966 | Allen et al. | 52/586 |
| 3,363,378 | 1/1968 | Palfey | 52/309.2 |
| 3,415,028 | 12/1968 | Nerem | 52/309.9 |
| 3,436,883 | 4/1969 | Charman et al. | 52/127.1 |
| 3,462,897 | 8/1969 | Weinrott | 52/90 |
| 4,039,019 | 8/1977 | Hopper | 160/121 |

FOREIGN PATENT DOCUMENTS

| | | | |
|---|---|---|---|
| 946337 | 12/1948 | France | 52/299 |
| 1010738 | 3/1952 | France | 52/586 |

*Primary Examiner*—James L. Ridgill, Jr.

[57] ABSTRACT

A prefabricated, low-energy building adapted to be erected on a usual foundation wall, has a prefabricated modular post and beam frame of heavy wooden timbers fastened together with hardware concealed from within the building. The timbers are relatively short and light in weight permitting the construction to be completed on the site one floor level at a time and allowing the frame to be extensible in length, width and height to form buildings of diverse exterior shape and size. The side walls, end walls and roof of the building are completed by a prefabricated modular panel system including frameless sandwich type panels which are secured to the outside of the framework and envelop the latter from the roof ridge to and below the top of the foundation wall. The panel system also includes means for sealing against infiltration and conduction heat losses through the walls and roof and also between abutting panels. Improvements in the modular frame and panel systems are disclosed which greatly simplify the erection and utility of the building.

17 Claims, 14 Drawing Figures

LOW ENERGY BUILDING

DESCRIPTION

1. Technical Field

This invention relates to energy efficient modular building construction and more particularly to an improved prefabricated wooden post and beam framing system and an improved prefabricated insulated panel system which, when the panels are applied to the exterior surfaces of the frame, provides a continuous insulating envelope extending from the roof ridge down to and below the top of the foundation wall of the building.

2. Background Art

The original mortise and tenon and hardwood pegged joints characteristic of post and beam framing in the 18th and 19th centuries in this country do not lend themselves to prefabrication. If entire walls or bays were constructed and raised at one time, the work of making the joints was done on the site and erecting the frame required large work crews and staging. Later various forms of massive hardware were developed to connect the heavy frame members but these were unsightly and expensive and found little favor in residential housing. The post and beam frames of this era were usually finished with vertical siding. More recently the posts have been spaced four feet on centers in order to use modular panels, but the panels used have lacked certain characteristics which allowed them to be efficiently mass produced and to be handled, stored and erected by relatively unskilled labor without damage. These prior post and beam constructions required long, heavy timbers for strength and regidity. As increased demands are made upon our shrinking forest resources and the trees suitable for timbers of this size decreases the availability of these long, heavy timbers has decreased and the cost has increased. Further, the handling of these long, heavy timbers is cumbersome and virtually eliminates the possibility of efficient factory fabrication, but these prior art panels, for example, requires that a large number of different panels be produced due to having a left and right side or a top and bottom which are different, all of which prevents interchangeability of panels, causes waste of material when angle cuts are made and mistaken identity during manufacture, shipping and erection of the building.

Further prior prefabricated panels have had edges which overlap in order to prevent heat loss between panels. These fragile edges result in difficulty in storing, shipping and erecting the panels. Also these overlapping edges greatly increase the difficulty of fastening the panels to the frame and make it impossible to tell by inspection whether the seal between panels has been installed because the seal is concealed by the lap. Many of the prior art panels have included interior frame members which have required special on-site treatment at locations where door and windows are to be installed.

Disclosure of Invention

This invention relates to low energy building construction and more particularly to residential and moderately sized commercial buildings characterized by a limited number and size of simple components interchangeable between buildings of diverse exterior size and shape. The framing system is modular and of post and beam construction, is expandable in length, width and height and may be completed one floor at a time.

Framing members do not protrude beyond the plane of the walls and roof and are fastened together where needed with hardware which is concealed. The framing members, which are relatively short, lend themselves to prefabrication and easy storage and handling. Horizontal framing members in the framing system which would interfere with the random placement of exterior doors and windows are absent. The side walls, end walls and roof are formed by improved modular prefabricated panels which are secured to the exterior surfaces of the frame in abutting relation so as to form a complete and continuous envelope of insulating material from the roof ridge down to and below the top of the foundation wall. The standard panels which are rectangular in all dimensions including the edges comprise a thick core of insulating material sandwiched between a sheet of thinner siding material such as plywood adhesively secured to form the exterior surface of the panel and a layer of finished material adhesively secured to the other side of the core which forms the finished surface of the interior rooms. There are no framing members in these panels.

It is therefore an object of this invention to provide an improved modular framing and panel system for the construction of low energy buildings.

Another object of this invention is to provide framing and panel systems for such buildings which are specially adapted to be prefabricated and transported to the building site as a package to be erected by semi-skilled labor on a previously prepared foundation.

A further object of the invention is to provide an improved prefabricated building construction which is entirely modular to allow expansion of the building in length and width and height and diverse outside size and shape.

A still further object of the invention is the provision of an improved prefabricated post and beam building of this type in which provision is made for concealed wiring in the framing members where required.

A yet further object of this invention is to provide means for the preliminary support of the first floor panels during construction which becomes an attractive part of the finished building.

A further object of the invention is the provision of a tolerance rout on the edges of the panels for insuring that the inner finished layers of side-by-side panels are in close abutting relationship.

Other objects and advantages of this invention are the provision of a post and beam framing system fora multistory post and beam building which can be erected one story at a time, in which a minimum number of different framing members is required for buildings of diverse shapes and sizes, in which no hardware required to join timbers is left exposed to the interior or exterior of the building, and in which freedom to locate exterior doors and windows at any standard location on the exterior of the building is allowed without redesign of either the frame or the panels.

Other objects and advantages of this invention will be pointed out or will become obvious from the following detailed description of a typical building shown in the accompanying drawings.

BEST MODE FOR CARRYING OUT THE INVENTION

Figure 1:
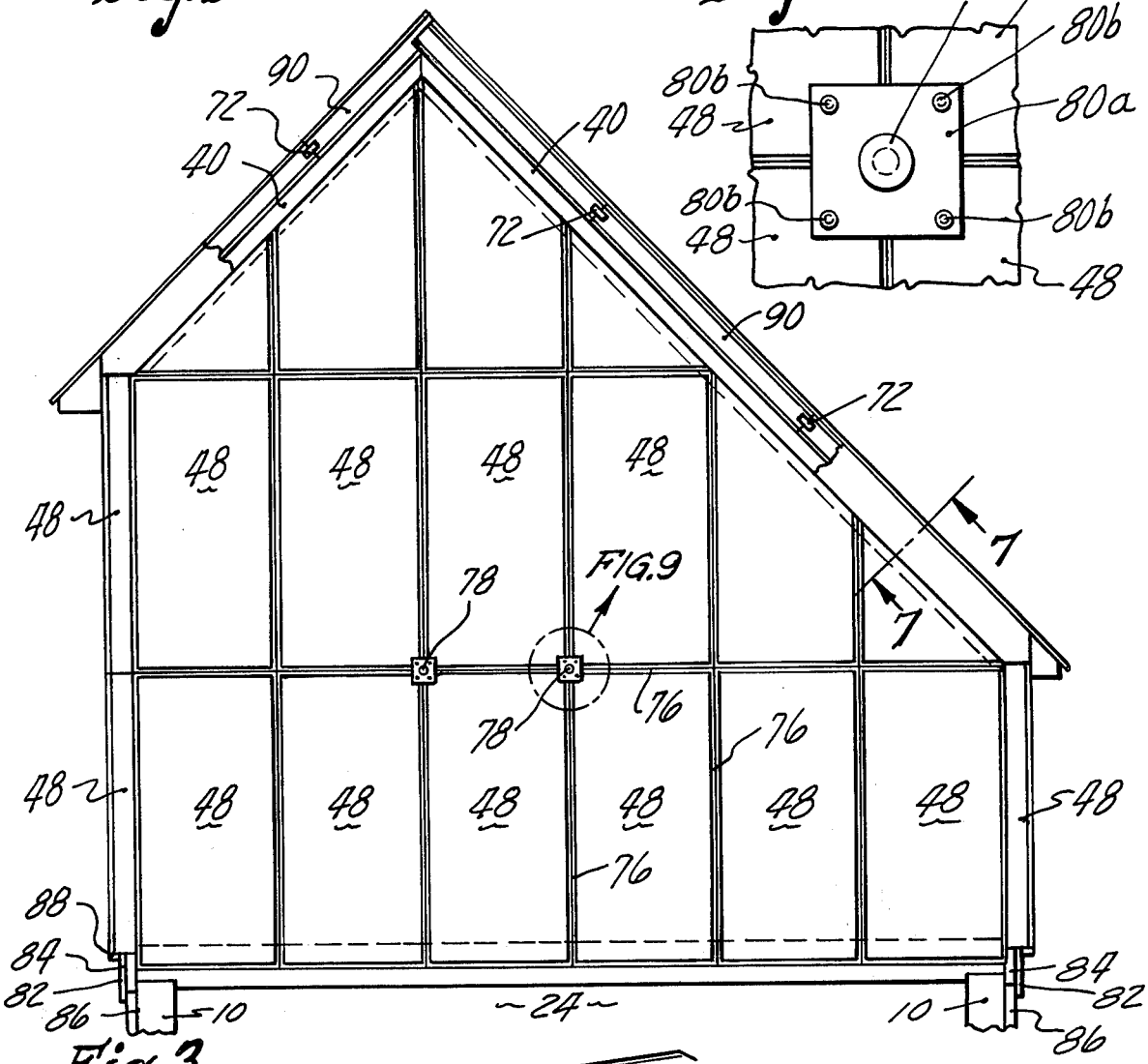
FIG. 1 is an end elevation of a residential building embodying the invention.
Figure 4:
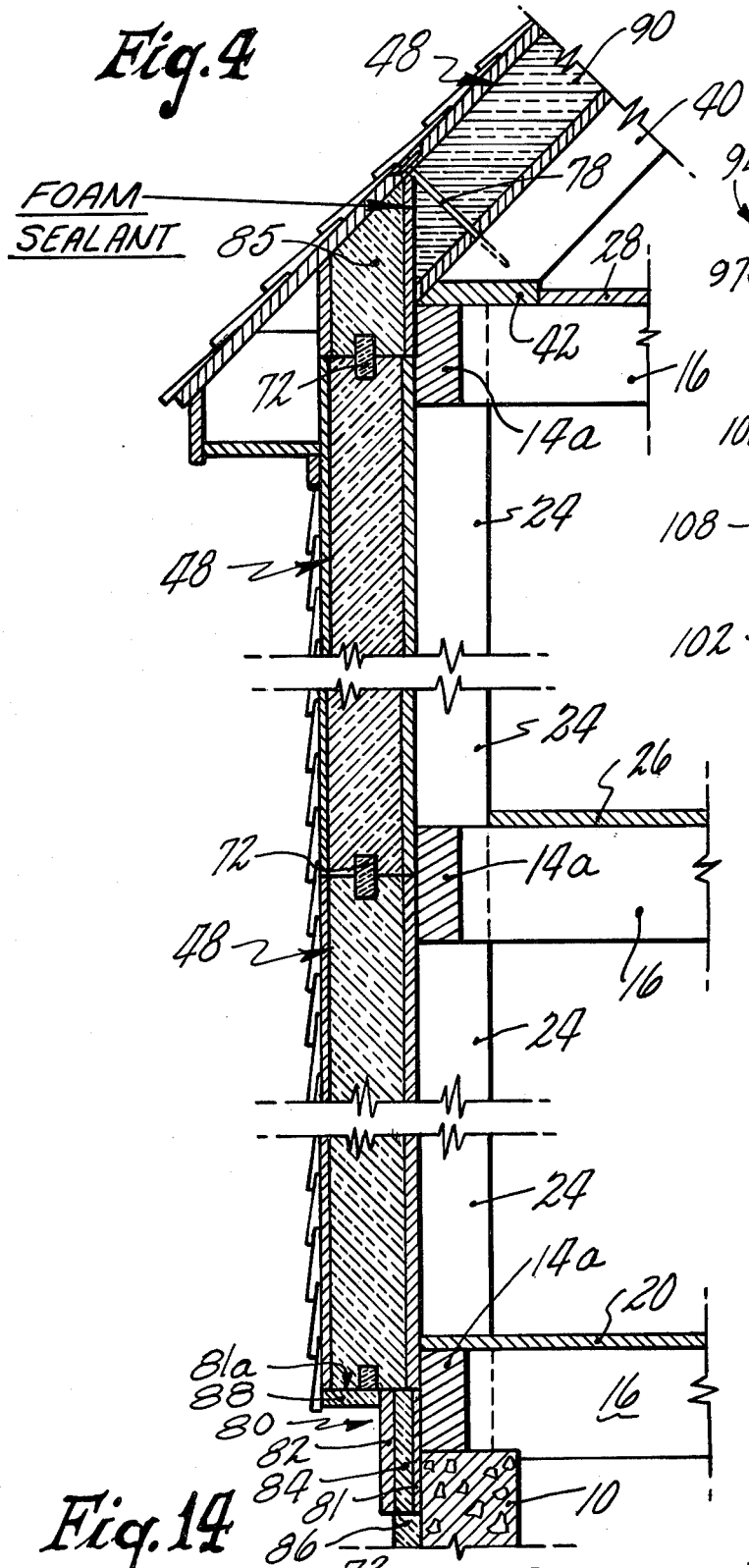
FIG. 4 is a vertical section illustrating the junction of the front wall and roof at the eaves.

The residential house chosen to disclose the invention consists of a modular post and beam framing system and a modular panel system both of which are prefabricated and furnished to the builder ready to be erected on a previously prepared foundation 10 (FIGS. 1 and 4).

Figure 2:
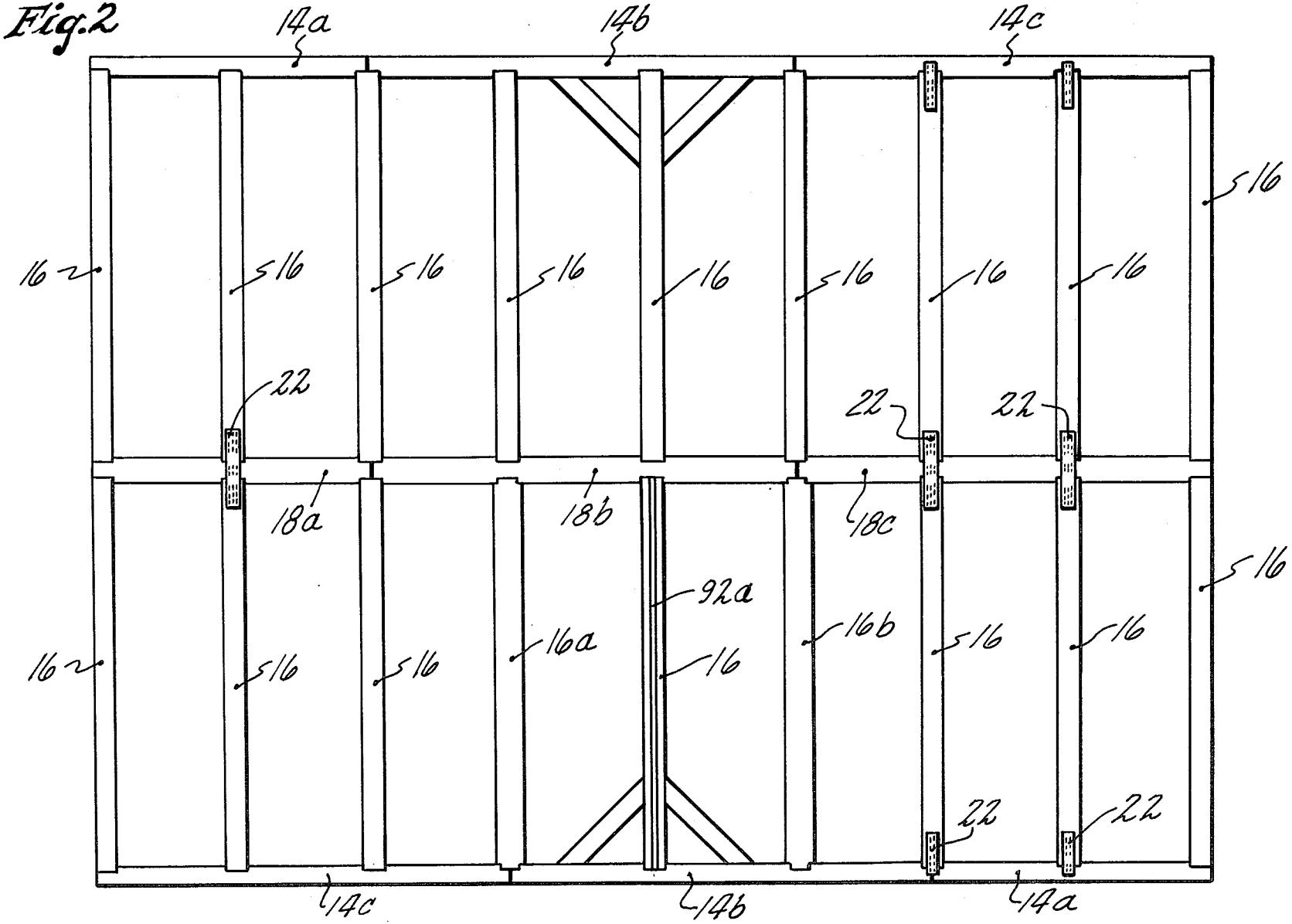
FIG. 2 is a plan view of the floor framing system.
Figure 12:
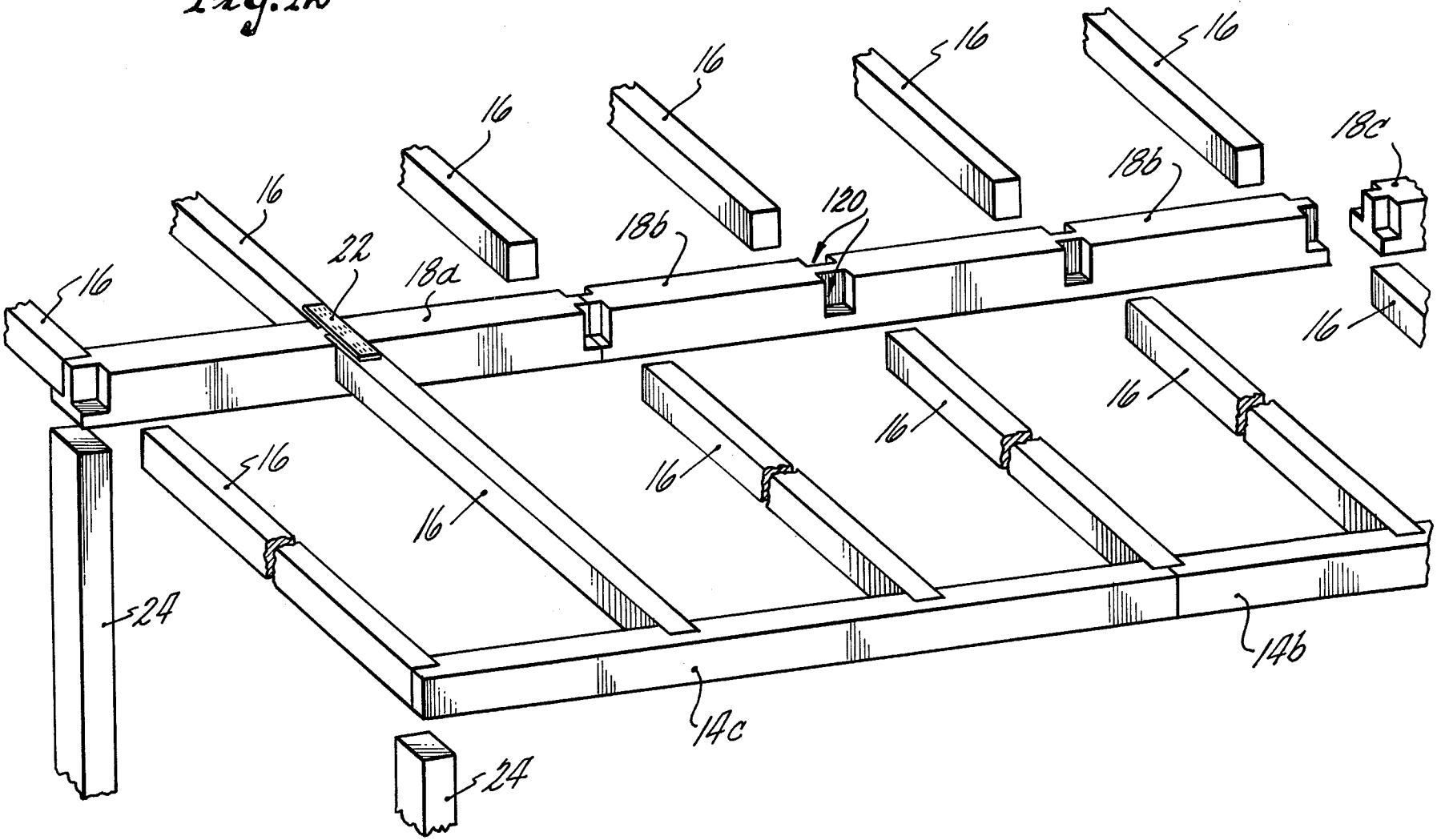
FIG. 12 is an exploded perspective view of the floor framing system of FIG. 2.

The Framing System: The first floor framing is shown most clearly in FIGS. 2 and 12 and consists of wooden beams 16 which form the sills at the two ends of the building and beams 14*a*, 14*b*, 14*c* which form the sills at the front and the rear of the building respectively. It will be noted that beams 16 are simple rectangular beams, square at their ends, while beams 14*a*, 14*b* and 14*c* are notched to receive one end of beams 16 which are the floor joists for the first floor of the building. A central main load bearing support comprises relatively short beams 18*a*, 18*b* and 18*c* which are notched to receive the ends of floor joists 16. These notches are shown most clearly in FIG. 12.

The house shown is 32′×24′ in plan and it will be noted that sills 14*a*, 14*b* and 14*c* are 8′, 12′ and 12′ in length respectively while end sills 16 are 12′ in length. All the framing structure so far described consists of short simple beams easily prefabricated and easily handled by a crew of two men. It will also be noted that heavier floor joists can be accommodated where needed in this framing, as indicated by joists 16*a* and 16*b* (FIG. 2) which are required in the salt box home shown due to its longer rear roof. In the residence shown beams 16 are 5″×8″, beams 18*a*, 18*b* and 18*c*, also beams 16*a* and 16*b*, are 8″×10″.

Figure 13:
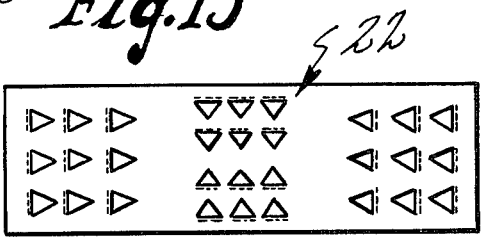
FIG. 13 is a detail of one of the spiked plates used to connect the beams of the framing system.

Flat spiked plates 22 (FIG. 13) are hammered over the joints of the framing to tie the beams together. A few of these are shown in place in FIG. 2. The first floor deck 20 (FIG. 4) which may be matched plywood or finished planks is laid on the framing members above described which locks the plates 22 in place and further ties the frame members together at this level.

Posts 24 (FIG. 4) are placed four feet on center on deck 20 around all four sides of the building, four feet being the modular width of the frame and panel systems. These posts are simple rectangular timbers square on both ends. The second floor framing structure which is identical with that shown in FIG. 2 rests on top of posts 24. The length of posts 24 is such that the horizontal beams comprising the second floor assembly will be located eight feet on center from the similar beams of the first floor assembly, as this is the modular height for the building frame and panels. Posts 24 are secured to the beams of the floor framing assemblies by spiked plates 22, these being applied to the exterior surface of the framing at both the upper and lower ends of posts 24. Posts 24 similarly spaced four feet on center support the framing for the second and third floor assemblies. This framing structure is identical with that shown in FIG. 2 except that at the third floor it is eight feet shorter, terminating as shown in FIG. 1 where it meets the beams at the rear roof of the building.

The framing is completed by rafters 40 spaced four feet on centers which extend at the front of the building from plate 42 (FIG. 4) to the roof ridge. At the rear of the building where the roof is longer two rafters placed end to end are required to extend from the eaves to the roof ridge, the lower ends of these rafters resting on plates 42 provided at each flooring assembly as shown in FIG. 4. It will be noted from FIGS. 1 and 4 that rafters 40 do not project at their lower ends beyond the front and rear wall framing members.

Figure 3:
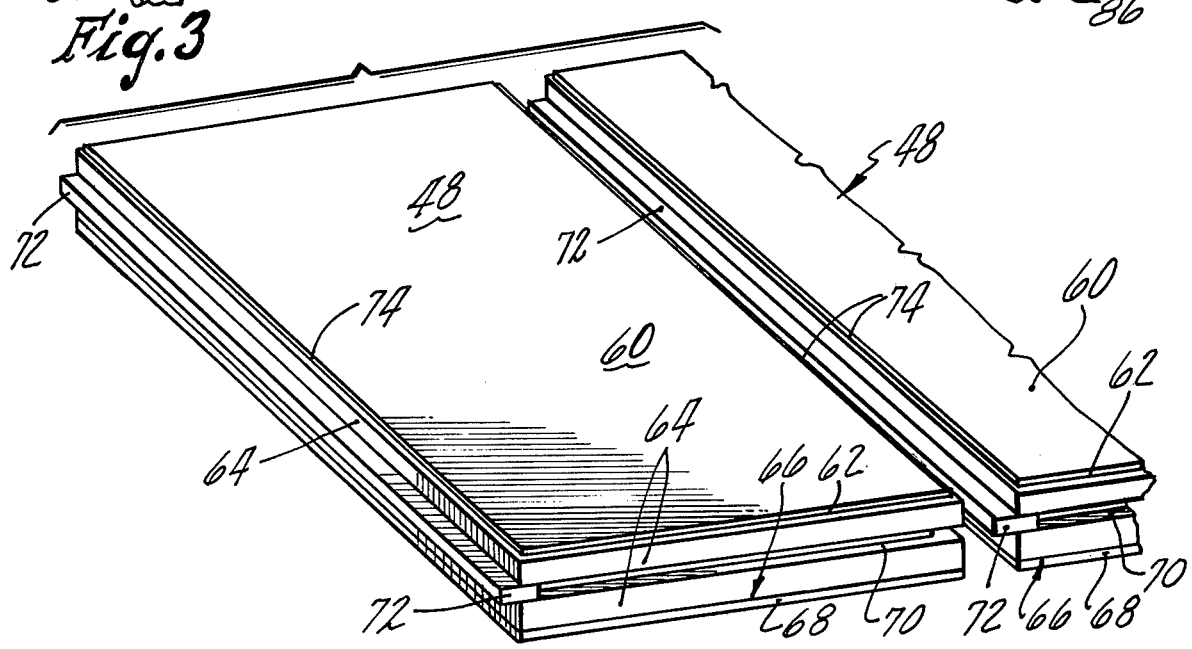
FIG. 3 is a perspective view of a modular panel showing how adjacent panels are joined.

The Panel System: The improved panel 48 of this invention (FIG. 3) is of the laminated, or sandwich type. It is four feet wide and eight feet high, as this the modular size of both the panel and the framing systems, and comprises an external siding layer 60 preferably of plywood, connected by adhesive layer 62 to a thick insulating core layer 64 of foam plastic which is connected by adhesive layer 66 to interior layer 68 preferably wood boards, panelling or other interior finish material. Layer 60 is ½″ exterior plywood, the core 64 is 8″ think and the inner layer 68 is preferably 1″ finished panelling, providing a panel having an insulating factor of R-38. A groove 70 is routed around all four edges in core 64 to receive insulating splines 72 of sufficient dimensions to completely occupy the grooves 70 in abutting edges of adjacent panels.

Figure 14:
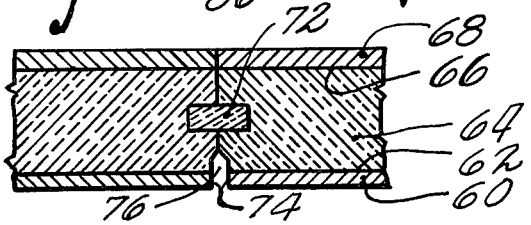
FIG. 14 is an enlarged detail showing spacing provided between the exterior siding layers by the tolerance rout on abutting edges of adjacent panels.

An important feature of this invention is the provision of a tolerance rout 74 (FIGS. 3 & 14) about the perimeter of each panel in the vicinity of the layer 60 which extends through the layer 60 and a short distance into the material of insulating core 64. This tolerance rout provides a small space 76 (FIG. 14) at the junction of the abutting edges of all adjacent panels which allows easy entrance of a long spike 78 (FIG. 8) by which the panels are fastened to the framing as hereinafter described. The tolerance rout also insures that the interior finish layers 68 of adjacent panels abut tightly. If the exterior layer 60 of the adjacent panels are not trimmed back as shown in FIG. 14 by tolerance rout 74 and the panels are not carefully machined and dimensionally accurate, it is likely that the exterior panel surfaces of adjacent panels would touch, preventing the interior surfaces 68 of the panels from abutting tightly. This tight abutting of the finish layers is desirable since the inner surfaces of layers 68 of the panels provide the finished inner walls of the rooms of the dwelling.

Method of Applying the Panels: Once the skeletal post and beam framing has been erected, an improved laminated panel supporting ledger assembly 80 (FIG. 4) is fastened to the first floor framing members after being very carefully leveled. Assembly 80, shown in cross section in FIG. 4, consists of a layer of wood 82 laminated to a layer of insulating board 84 which can be polystyrene or urethane foam board between one and three inches in thickness. A thin metal plate 81 is laminated to the other side of insulating board 84 to stabilize the assembly 80 and prevent warping. The laminated ledger assembly is approximately 12" wide and of appropriate length to be handled by one man. Assembly 80 is fixed to the exterior surface of the first floor framing by nails with the metal plate 81 against the building and the panel board 82 facing away from the building. The ledger assembly extends below the top of the foundation wall 10 and preferably contacts the styrofoam insulation 86 on foundation wall 10. The ledger assembly is cut to length to fit and extends completely around the building with miter or butt joints between lengths and becomes a permanent part of the building.

The insulating panels 48 for the first story rest at their lower edges on the ledger assembly 80, a layer of sealing material 81*a* being applied to the bottom edge of the panels. This seal is shown in FIG. 4 and forms a continuous seal against air infiltration at the critical area between the sill 14*a*, 14*b* and 14*c* and foundation wall 10. A finish board 88 is fastened to the bottom of panel 48, a foam sealant being applied to seal the insulating core 64 of the panel.

Figure 9:
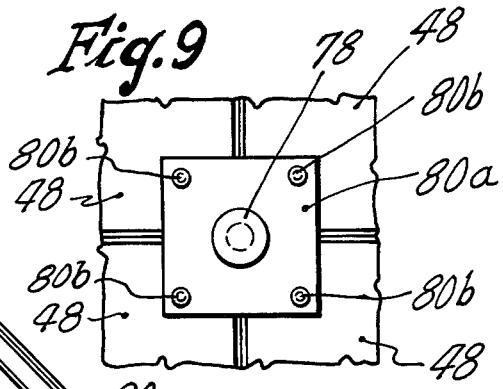
FIG. 9 is an enlarged detail of the panel fastener shown in place in FIG. 1.
Figure 6:
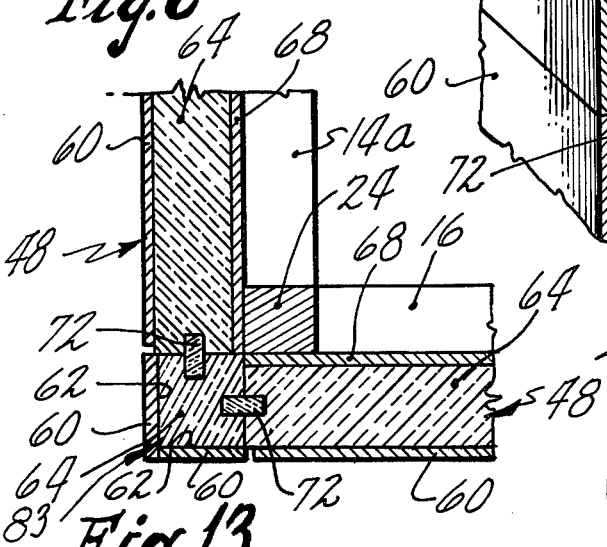
FIG. 6 is a horizontal section taken at the right front corner of the building.

FIG. 6 shows a horizontal section taken at the right hand lower corner of the building. The first panel for the front wall of the building is positioned with its bottom edge on the horizontal ledger assembly 80, which has been carefully leveled, with its right hand edge flush with the end of the building frame. In applying all of the panels to the building frame a construction adhesive is applied to abutting surfaces of the panel and the frame. The eight front wall panels are applied one at a time, splines 72 being inserted in grooves 70 in their abutting edges, with their inside adjacent finish layers 68 abutting. As the panels are applied each panel is secured by at least one spike 78 (FIG. 8) which is passed through the center hole in a plate 80*a* and driven between abutting panels in the space 76 formed by the tolerance routs 74 in the abutting edges of the two side-by-side panels. As the spikes are driven, the panels are prevented from separating by the plate 80*a* previously secured to the adjacent panels by nails 80*b* driven through the corner holes in the plate. When the first story panels are in place, the second story panels are applied in the same manner, splines 72 of insulating material being inserted between the top and bottom edges of the first and second story panels. The gable panels on the end walls of the building are similarly applied. These are standard panels cut to match the roof pitch. Final nailing of the panels is now possible using the fastening device of FIG. 8 at adjacent corners of four panels as shown in FIGS. 1 and 9.

Figure 8:
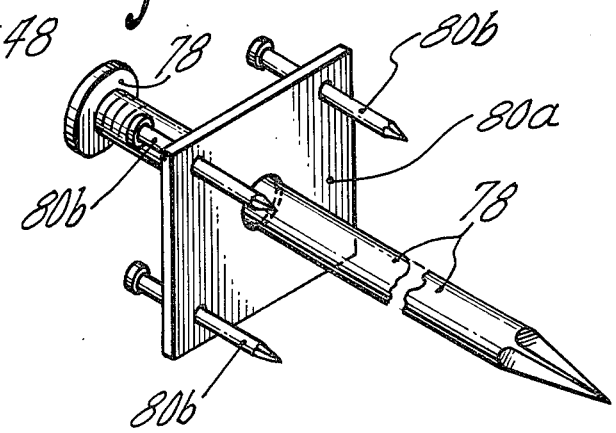
FIG. 8 is an enlarged perspective showing of a panel fastener.

It is important that in using the fastening device of FIG. 8 the four corner nails 80*b* be first driven through the plate and into the panels to secure the adjacent panels from being laterally displaced when the spike is driven. Also, it should be noted that in fastening the panels to the frame the spikes are not driven through the edges of the panels but between them, thus preventing damage to the panels by splitting. This also allows the heavy spikes to be centered in the frame members which avoids splitting of the frame members which so frequently happens when nailing through the edges of the panels.

Special eaves panels 85 (FIG. 4) are prepared by cutting a standard panel 48, the oblique cut being made at the correct angle to match the pitch of the roof and at the correct point to lie flush with the outer surface of an abutting roof panel.

Spacial corner panels are provided, one of which is shown at 83 in FIG. 6, to complete the panel system at the building walls. These are made from standard panel material and consist of an insulating core 64 to which exterior siding layers 60 are connected by adhesive layers 62 to adjacent sides of core 64. Inner adjacent edges have routed grooves 70 which match grooves 70 in the sidewall panels 48 and receive splines 72 in the edges of these panels. The corner panels are secured by long spikes 87 (FIG. 6).

Figure 5:
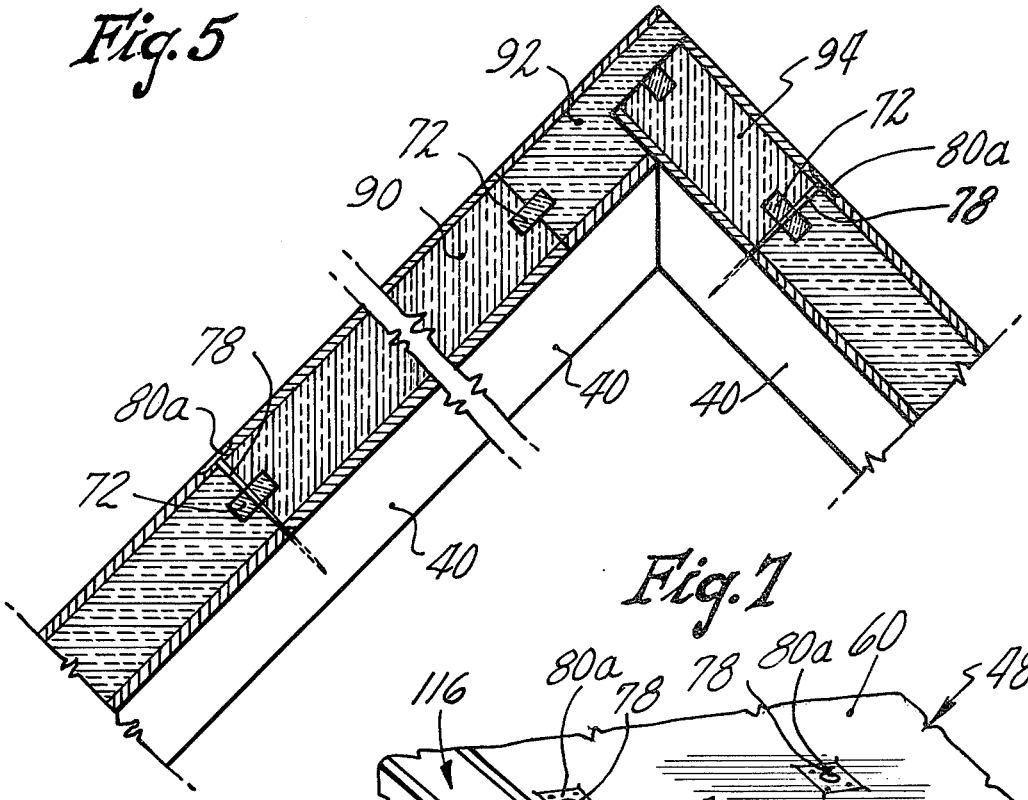
FIG. 5 is a vertical section through the roof showing the ridge.
Figure 7:
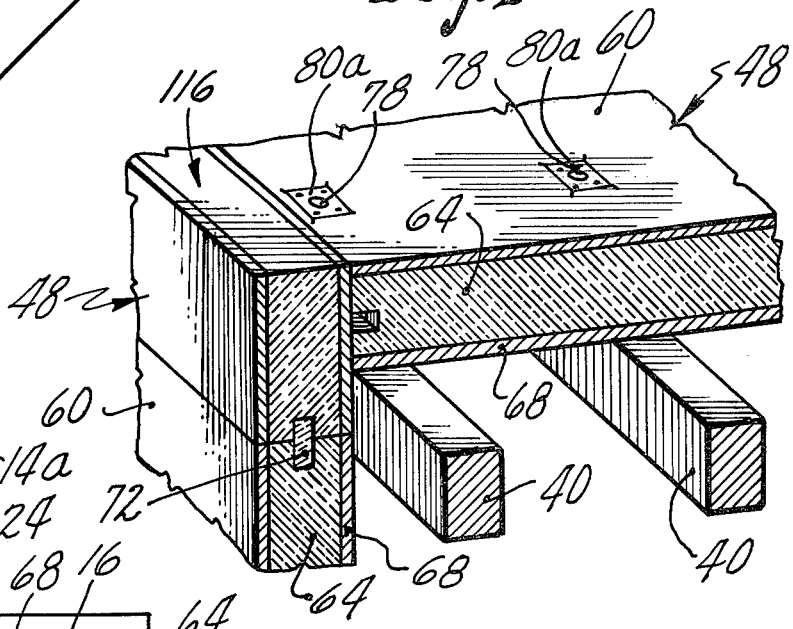
FIG. 7 is a perspective view taken on line 7—7 of FIG. 1 showing the junction of the roof panels and an end wall panel of the building.

The roof panels are shown most clearly in FIGS. 4, 5 and 7. FIG. 4 shows a roof panel 90 at the front of the house which is a standard panel 48 cut at its bottom edge to abut eaves panel 92. More accurately it is what was left of a standard panel which was cut to form adjacent side wall panel 85. A course of these panels is laid across the front of the house and spiked to rafters 40 which are four feet on centers. The roof panels are laid exactly as the side panels previously described. The final panel at the roof ridge is a short panel 92 (FIG. 5) which is notched at its upper end to receive the upper end of roof panel 94 which is also a short panel. The other roof panels on the rear roof are standard panels 48, the lowermost ones being cut obliquely to rest on plate 42 of the frame.

Figure 11:
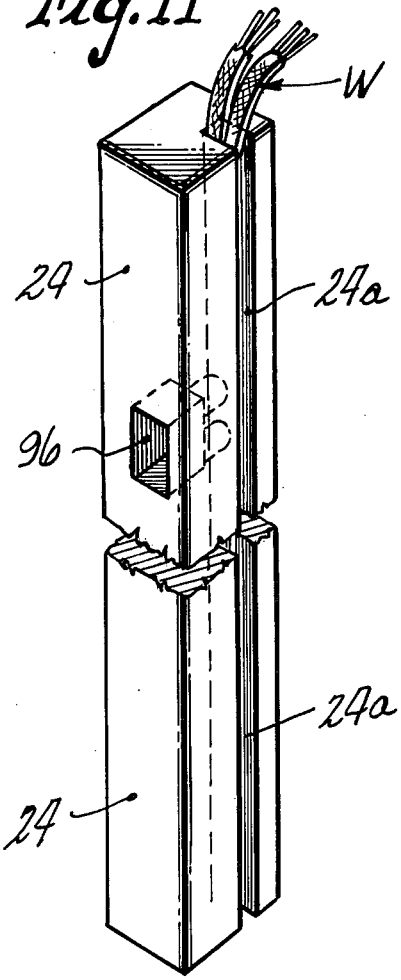
FIG. 11 is a detail of a wiring device in a post.

The interior partitions may be conventional stud and sheetrock and the electric wiring in these walls is conventional. Where electrical switches are to be located in an exterior wall, as adjacent an entrance, the adjacent post of the frame is routed at 24*a* as shown in FIG. 11 to receive the wires W. The switch box is mounted in an adjacent exposed face of the post at 96. If a ceiling light fixture is desired, a floor joist is routed in the same manner as indicated at 92*a* in FIG. 2.

Figure 10:
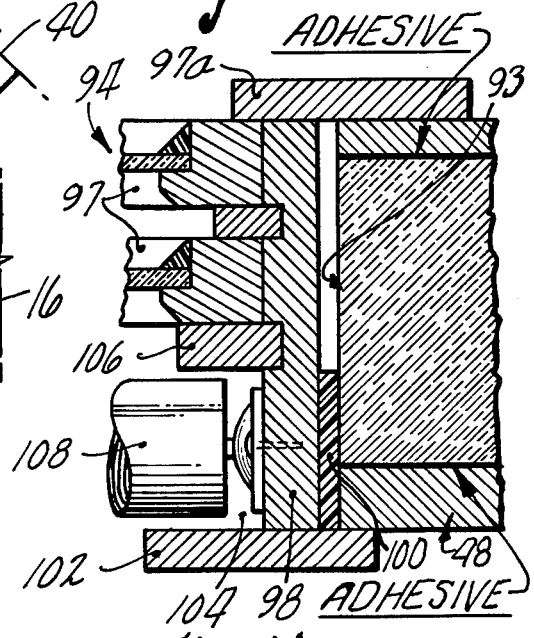
FIG. 10 is a window detail showing the housing for an insulating window shade.

As previously mentioned, the frame is completely free of horizontal framing members which would, if present, prevent installing a door or window without special framing work. A prefabricated door or window can be quickly installed in any full panel location by simply cutting a rectangular hole, or rouqh opening 93 (FIG. 10) in a standard panel 48. Such a prefabricated window assembly is shown in part in FIG. 10. The assembly includes a window sill (not shown), window jambs, one of which is shown at 98, window sash 97, and exterior casing members 97*a*. Before the assembly is inserted into the opening 93 in the panel a layer of construction adhesive is applied to the exterior layer of the panel 48 around the opening 93. After insertion, the assembly is secured by nailing through the casing members 97*a* into panel 48. A strip of insulating material 100 is inserted around the entire window opening in panel 48, as shown, between the jambs 98 and the panel. Inside casing members 102 are then nailed into place. It will be noted that casing members 102 extend into the window opening a substantial distance. The width of jamb members 98 is equal to the full thickness of panel 48 and window sash 97 are located adjacent the exterior window casings 97*a* thus leaving a generous curtain recess 104 between the stops 106 for sash 97 and inner window casing 102 which extends about the window opening and is adequate to house a roller curtain 108 of the multilayer type. Such a curtain contains a body of air in and between layers and is a very effective insulating barrier.

From the above description of a typical dwelling embodying my invention it will be evident that I have provided an improved post and beam framing system which enables a heavy frame to be erected by a two-man crew, utilizing relatively short timbers which permit erection one story at a time. Further, these timbers can be readily prefabricated by relatively unskilled workers and, by reason of their modular dimensions, can be used to construct buildings of widely differnt style, size and shape.

It will further be obvious that I have provided improved means for connecting these timbers by metal fasteners which are secured by decking and panel material that covers these fasteners and prevents their displacement while rendering them invisible in the finished building.

Further, by use of improved modular panels, applied to the outside surfaces of the framing walls and roof, I have been able to provide an insulating envelope which extends unbroken from the roof ridge to and below the top of the building foundation while also providing finished interior surfaces for the walls and ceilings of the interior rooms.

My invention also provides improved ledger means for initially supporting the first floor wall panels during their erection and for providing a permanent and finished appearance at the lower ends of these wall panels.

I have also, by my invention, provided an improved laminated panel free from framing which includes an outside layer of external siding material laminated to one side of an insulating core and an inside layer of finish material laminted to the other side of said core which forms the finished wall surface for the interior rooms of the building. These roof and wall panels are also provided with a novel tolerance rout at their abutting edges extending through the exterior siding material and a short distance into the insulating core which assures the close abutting engagement of adjacent panels at their inside finish layer while also providing a space between the outer exterior layers of adjacent panels to permit spikes to be driven through between panels into the center of the framing members. The use of rectangular plates for attaching the panels at the joints between adjacent panels is also a novel feature of the invention, with their corner nailing holes, which permits the plates to be nailed to four adjacent panels before the spike is driven through the central hole in the plate and into the frame. The use of this nailing device permits the panels to be nailed to the frame by long heavy spikes passing between the edges of the panels into the center of the framing member instead of passing through the margin of the panel into the edge of the framing member.

My invention also provides a standard panel which permits the installation of a prefabricated door or window assembly at any standard location in an outside wall by simply cutting a hole in the panel to receive the assembly. In a window assembly, means is provided to mount a multi-layer insulating roller curtain between the side window jambs of the assembly.

While I have described my invention in its preferred form in considerable detail, I do not want to be limited to the exact form shown and described since the invention is applicable to many different buildings and changes will be obvious to those skilled in this art which fall within the scope of the following claims.

I claim:

1. A low energy building having one or more stories adapted to be erected one story at a time on an existing foundation from prefabricated components comprising:

a modular post and beam framing system including:

short, integral beams of at least two modules length having vertical rectangular joist notches cut therein at modular increments along their length, floor joists having their ends seated in said notches, a plurality of boards laid on top of said beams and said joists forming a floor at each story of the building, posts upstanding from said floors at suitable spacing and height to provide modular openings for the side and end walls of the building roof rafters supported at one of their ends on said beams and meeting at another of their ends at the roof ridge, a plurality of prefabricated laminated panels secured to said framing system and covering said openings;

said panels having a central core member of insulating material, an outer layer of siding material connected to one side of said core by a layer of adhesive, and an inner layer of finish material connected to the other side of said core by a layer of adhesive.

2. The framing system in accordance with claim 1 wherein sheet metal spiked plates are secured to the tops of said short, integral beams and joists overlying their abutting areas.

3. A building according to claim 1 wherein rectangular plates are nailed to adjacent panels through the predrilled holes provided at each corner of said plates and said panels are spiked to the outside surface of said framing system by spikes extending through a central hole in said plates and between the edges of adjacent panels.

4. The low energy building according to claim 1 wherein means are provided to disguise the longitudinal exposed joint between two adjacent inner layers of finish material on said laminated panels comprising:

said inner layer having a plurality of wood boards oriented to extend the full length of said laminated panels, wherein the joints between said boards appear visually identical to the tightly abutting joint between two adjacent panels.

5. A laminated panel system wherein said panels are applied to the side and end walls of a building and to the roof rafters and present a continuous insulating envelope which extends from the roof ridge to and below the top of the foundation comprising:

an insulation-to-insulation joint where the vertical wall panels meet the sloping roof panels, an insulation-to-insulation joint where the end wall panels meet the side wall panels, and an insulation-to-insulation joint where the roof panels from one side of the roof meet the roof panels from the other side of the roof.

6. A panel system according to claim 5 having a prefabricated ledger assembly including a layer of finished wood laminated to the outside of an insulating board of substantial thickness, a thin sheet of material laminated to the inside of said insulating board, said ledger assembly being fixed to the first floor assembly and of sufficient width to extend below the joint between the beams and joist of said first floor assembly and the top of the foundation wall of the building, said ledger assembly consisting of sections of convenient length joined together at their abutting ends and extended continuously about the entire building and providing a level base on which to support the first floor panels during erection and forming a permanent and attractive part of the finished building.

7. The panel system according to claim 5 wherein first floor wall panels extend below the surface of the first floor, thereby insulating the area at the joint between the wall framing and the floor.

8. A low energy panel system adapted to be erected on an existing foundation from prefabricated components wherein a means is provided to position the continuous insulation layer of said panel system in closely abutting relation to the frame of a window and in which one or more panels are adapted to have a rectangular opening cut therein to receive a prefabricated window assembly comprising:

window jambs in closely abutting relation to foam insulation around the entire perimeter of said rectangular opening from the innermost edge of said foam insulation to the outermost edge, an exterior casing overlying said panels and secured to said outside layer of said panel about the window opening therein, an inner casing secured to said jambs and to said inside layer of said panel.

9. The panel system in accordance with claim 8 wherein a layer of foam sealant is provided between the window jambs and the insulating core material of the adjacent panel.

10. The panel system in accordance with claim 8 wherein a prefabricated door assembly is installed in said rectangular opening.

11. On a low energy modular panel system a means of filling the insulation void created by the intersection of standard side wall and roof panels, comprising:

a special laminated eave panel to nest with the first roof panel to provide continuity of insulation between wall and roof.

12. The panel system in accordance with claim 11 wherein said special eave panel is derived from a standard modular panel and whereby the remaining piece of said standard modular panel complements the angle of said special derived eave panel to form the first row of roof panels.

13. On a low energy panel system a means of filling the insulation void created by the intersection of standard side wall and end wall panels, comprising:

a special laminated corner panel to nest with the side wall and end wall panels to provide continuity of insulation between wall and roof panels.

14. On a low energy panel system a means of filling the insulation void created by the intersection of standard end wall and roof panels, comprising:

a special laminated rake panel to nest with the top row of end wall panels and the roof panels to provide continuity of insulation between wall and roof.

15. A modular floor and ceiling assembly for a post and beam building comprising:

short integral beams placed end-to-end having vertical joist notches therein at modular increments along their length, short joists having their ends seated in the notches in said beams, sheet metal spiked plates fastened to the tops of said beams and joists at their areas of abutment, and finished material fastened to the tops of said beams and joists overlying said plates and presenting finished surfaces for floor and ceiling.

16. The modular floor assembly in accordance with claim 15 wherein means are provided to support a partial roof weight load comprising:

a carrying beam floor joist of greater cross-section than said typical floor joists, and having both ends milled to precisely fill said vertical rectangular joist notches.

17. A prefabricated laminated panel adapted for use in modular construction, comprising:

an outside layer of exterior siding material, a thick core of insulating material, an inside layer of finish material, layers of adhesive material between said core and said inside and outside layers, and means of insuring that said inside layer of finish material of adjacent panels engage in closely abutting relation said means comprising a tolerance rout about the margin of said exterior siding material which extends through said material and a short distance into the adjacent core material.

* * * * *